US006265828B1

(12) United States Patent
Jansson

(10) Patent No.: US 6,265,828 B1
(45) Date of Patent: Jul. 24, 2001

(54) HAND LAMP

(76) Inventor: Rolf Jansson, Ungdomsvagen 77, Taby (SE)

( * ) Notice: Subject to any disclaimer, the term of this patent is extended or adjusted under 35 U.S.C. 154(b) by 0 days.

(21) Appl. No.: 09/508,517

(22) PCT Filed: Sep. 17, 1998

(86) PCT No.: PCT/SE98/01669

§ 371 Date: Mar. 24, 2000

§ 102(e) Date: Mar. 24, 2000

(87) PCT Pub. No.: WO99/18388

PCT Pub. Date: Apr. 15, 1999

(30) Foreign Application Priority Data

Sep. 25, 1997 (SE) ..... 9703464

(51) Int. Cl.[7] ..... F21L 7/00
(52) U.S. Cl. ..... 315/76; 315/363; 362/190
(58) Field of Search ..... 362/190, 197, 362/198, 396; 315/76, 363

(56) References Cited

U.S. PATENT DOCUMENTS 2,230,458 2/1941 Hummert ..... 240/10.6
3,851,166 11/1974 Kohler ..... 240/57
5,012,394 4/1991 Woodward ..... 362/198

FOREIGN PATENT DOCUMENTS 4227629 2/1994 (DE) .

*Primary Examiner*—David Vu
(74) *Attorney, Agent, or Firm*—Jacobson Holman PLLC

(57) ABSTRACT

A cable lamp which is powered by a low-voltage battery and which comprises a cable (10). Fitted on one end of the cable (10) is fitting (14) for a fluorescent bulb (21), while the other end of the cable has fitted thereon a battery connection (30, 40) for connecting both cable conductors (11, 12) to respective battery terminals. The lamp also includes an electronic HF ignition (22) for igniting the bulb. The ignition (22) is adapted for both AC and DC mains voltages and is connected directly to terminal clip (30) that has a converter (18) which converts the battery low-voltage to DC mains voltage. The converter (18) is encapsulated in a radiation impervious housing (322, 323, 324) which forms on the one hand a high-frequency transformer component of the converter (18) and a converter cooling element on the other hand.

2 Claims, 1 Drawing Sheet

Fig. 1
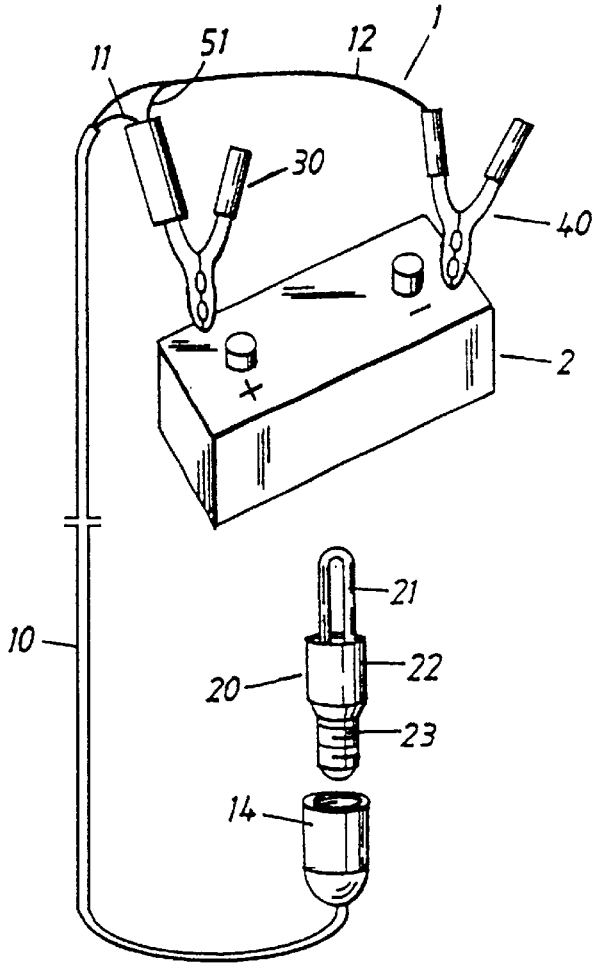
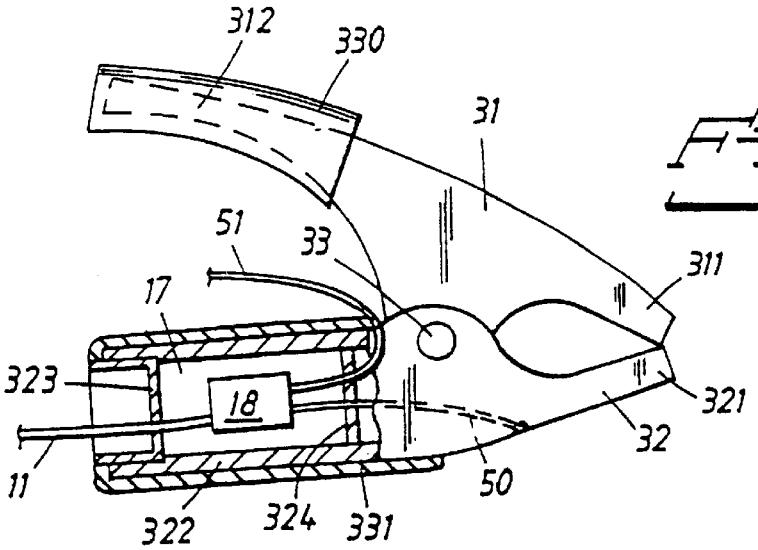
Fig. 2

HAND LAMP

BACKGROUND OF THE INVENTION

Field of the Invention

The present invention relates to a hand lamp which is powered electrically by a low-voltage battery, such as a vehicle battery, and which is of the kind defined in the hand lamp powered by a low-voltage battery.

A hand lamp of this kind will include an electric cable that has a fluorescent tube fitting at one end thereof, a battery connector means connected to the other end thereof, the cable including two conductors which are each provided with connector means for detachable connection to a respective terminal of the battery, and further includes fluorescent tube lamp, and an electronic HF lamp ignition means.

A hand lamp of this kind has the advantage of providing a high light yield or luminous efficiency in relation to energy consumption.

It is important to be able to minimize the energy consumed by a lamp in relation to a given luminous flux, particularly in the case of water-going vessels, such as motorboats, yachts, and also with respect to cars and the like, which, in practice, carry only a single source of current in the form of a low voltage battery (12 volt accumulator). In order to enable the light sources to be used comfortably, it will preferably be connected to the battery by means of a long cable that will allow the light source to be moved to a position located at a relatively long distance, from the battery.

It is known to use to this end a hand lamp whose light source consists of a low-energy bulb, for instance a halogen bulb of good efficiency that can be operated on battery voltage. However, as a result of the requisite length of the hand lamp, the power losses in the cable become problematic.

These losses can be alleviated by using heavy gauge cable conductors, although this renders the cable expensive and difficult to handle. It is also known to use a light source in the form of a compact fluorescent tube and to energize the tube with the aid of an ignition means fitted at each end of the cable. If the converter is placed at the battery end of the cable, the cable conductors will transmit high frequency noise, owing to the fact that the ignition means, or igniter, includes a high frequency converter. This means that at latest the cable must be screened along the whole of its length, causing the cable to become relatively heavy, clumsy and expensive. If the HF device is, instead, place in the proximity of the light source, the power loss in the cable will become problematic unless the cable conductors are given a heavy gauge, although this will again result in a cable which is heavy, difficult to handle and above all, expensive. The HF device located in the proximity of the light source will, of course, also generate a high frequency disturbance.

SUMMARY OF THE INVENTION

The object of the present invention is to provide a hand lamp that can be connected to a low voltage battery and with which the aforesaid drawbacks are limited.

This object is achieved with an inventive hand lamp having the features set forth in the hand lamp comprising a cable having at one end a fitting for a fluorescent bulb, and at its other end a battery connection device for connecting both conductors of the respective battery terminals. An electronic HF ignition means is adapted for AC and DC mains voltages and is connected directly to the bulb. The battery connecting device comprises a terminal clip that includes a converter which converts the battery low-voltage to DC mains voltages. The converter is encapsulated in a radiation-impervious housing which forms on the one hand a high-frequency transformer component of the converter and, on the other hand, a converter cooling means.

Further embodiments of the lamp are set forth in the converter is encapsulated in one arm of the terminal clip. The one arm of the clip has a tubular leg in which the converter is accomodated. Also, the outer wall of the housing is formed by the tubular leg of the clip.

The invention is based on the commnercial availability of energy-lean bulbs (for instance, bulb of the type Osram Dulox EL). Which include a compact fluorescent tube having connected directly thereto a HF ignition means which is powered by an AC or a DC mains voltage (110–230 volts). The energy-lean bulb has a conventional connection bass (E14) and can be connected to a rotatable bulb holder provided at one end of the cable. In accordance with the invention, a known converter is built into the battery connection means of the battery. The converter being designed to convert 12 volts DC to 110–230 volts DC, such as to supply the cable with 230 volts DC. This enables the cable to be made relatively slender and flexible and also relatively long (for example, given of ca 100 m) without the occurrence of problematic power losses in the cable. The converter is screened in the battery connection means so as to generate no disturbing HF transmission that might otherwise disturb radio equipment in the vehicle. This obviates the need of screening the lamp cable. A converter of the kind in question that can convert 12 volts DC to 110–230 volts AC will preferably operate at a relatively high frequency, so that it can be given small dimensions. By giving the converter, and also a subsequently coupled smoothing unit, small dimensions there is afforded the additional advantage of enabling the converter and the smoothing device to be accommodated in a tubular leg of a terminal connection clip, wherewith one tubular leg of the terminal connection clip forms the main part of a screen housing in which the converter and smoothing device are enclosed and HF sealed. The clip leg will therewith also form cooling means for conducting away heat generated by the converter. The clip leg also forms a protective converter housing.

In summary, there is obtained a hand lamp having a long, thin flexible cable with small energy losses and with which there can be used a commercially available fluorescent bulb with associated ignition means, wherewith the battery-connecting end of the cable may include a converter which is housed in a battery connector clip that also forms an HF sealed protective casing for the converter. Because of the high luminous efficency of the light source, the lamp can be powered for long periods of time by low capacity, low-voltage current sources, for instance lead batteries, solar cell panels and the like.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described in more detail with reference to the accompanying drawings, in which.

FIG. 1 is a schematic illustration of an inventive hand lamp connected to a battery; and FIG. 2 is a partial sectioned view of one terminal connector clip of the hand lamp.

DESCRIPTION OF THE INVENTION

The illustrated hand lamp 1 comprises a long cable 10 that includes two conductors 11 and 12. One end of the cable 10 is connected to a conventional incandescent bulb fitting (bulb holder) 14. However, the light source used with the illustrated cable lamp 1 is an energy-lean bulb 20 of the type Osram Dulox EL, which includes a compact fluorescent tube 21 having connected directly thereto and HF ignition mean 22 that includes conventional screw thread 23 corresponding to the screw thread of the conventional lamp-base of the fitting 14 (e.g. an E14 thread).

One conductor 11 is connected at the other end of the cable 10 to a first battery clip 30, while the other conductor, 12 is connected to a second battery clip 40. The first clip 30 being shown connected to the positive pole of a 12 volt battery 2 and the second clip 40 being shown connected to the negative pole of said battery.

It will be seen from FIG. 2 that the first connection clip 30 typically includes two lever arms 31, 32 that are mutually mounted on a pivot pin 33. The lever arms 31, 32 may be made of an electrically conductive material and are biased for pivotal movement by means of a spring (not shown), such that respective legs 311, 321 of the arms will be biased towards one another, whereas the other legs 312, 322 of the arms form manipulating legs that can be gripped with the hand so as to move the legs 312, 322 towards one another against the forces the spring and therewith open the clip 30. One leg, 322, is generally tubular and defines together with two separate end-pieces 323, 324 a closed, sealed chamber 17 which is screened by electrically conductive material. The chamber 17 accommodates a converter 18. The converter 18 is connected to the arm 32 by means of a conductor 50, and is supplied with +12 volts. The converter 18 is also connected be means of a cable 51 to the clip 40 for connection to the negative terminal of the battery 2. The converter 18 includes a first conventional means for converting a direct current voltage of 12 volts to a high-frequency alternating current of mains voltage, and a second means for substantially rectifying the transformed high-frequency alternating current voltage so as to supply the conductor 11 with a 230 volt DC, whilst the conductor 12 is connected to the negative terminal of the battery 2. The energy-lean bulb 20 will operate equally as well at 110–230 volt DC and 110–230 volt AC. Because the converter 18 operates at a high frequency, for instance a frequency in the order of 40 kHz, the converter 18 may be made so small as to enable it to be accommodated in the clip 30 and so that the heat generated by the converter 18 will be so slight as to enable the clip 30 to function as a converter cooling means. As evident from FIG. 2, the manipulating legs 312, 322 of the clip are covered with insulating jackets 330, 331, although it will be understood that both clips 30, 40 may be covered with an electrically insulating covering with the exception of those surfaces that are intended for contact with the battery terminals.

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims.

What is claimed is:

1. A hand lamp powered by a low-voltage battery, said lamp comprising a cable having at one end a fitting for a fluorescent bulb and at its other end a battery connection device for connecting both conductors of said cable to respective battery terminals, and an electronic HF ignition means is adapted for AC and DC mains voltages and is connected directly to the bulb; in that the battery connecting device comprises a terminal clip that includes a converter which converts the battery low-voltage to DC mains voltages; and in that the converter is encapsulated in a radiation-impervious housing which forms on the one hand a high-frequency transformer component of the converter and, on the other hand, a converter cooling means.

2. The hand lamp according to claim 1, wherein said one arm of said clip has a tubular leg in which the converter is accomodated; and in that the outer wall of the housing is formed by the tubular leg of said clip.

* * * * *